US012173990B2

(12) United States Patent
Salisbury et al.

(10) Patent No.: US 12,173,990 B2
(45) Date of Patent: Dec. 24, 2024

(54) ELECTRODE FOR A CONDUCTED ELECTRICAL WEAPON

(71) Applicant: Axon Enterprise, Inc., Scottsdale, AZ (US)

(72) Inventors: Luke Salisbury, Scottsdale, AZ (US); Albert Lavin, Scottsdale, AZ (US); Milan Cerovic, Scottsdale, AZ (US); Magne Nerheim, Paradise Valley, AZ (US)

( * ) Notice: Subject to any disclaimer, the term of this patent is extended or adjusted under 35 U.S.C. 154(b) by 0 days.

(21) Appl. No.: 18/139,733

(22) Filed: Apr. 26, 2023

(65) Prior Publication Data

US 2023/0288174 A1 Sep. 14, 2023

Related U.S. Application Data

(63) Continuation of application No. 17/245,376, filed on Apr. 30, 2021, now Pat. No. 11,668,548, which is a continuation of application No. 16/876,907, filed on May 18, 2020, now Pat. No. 11,022,409, which is a continuation of application No. 16/672,216, filed on Nov. 1, 2019, now Pat. No. 10,690,455, which is a continuation of application No. 16/189,604, filed on Nov. 13, 2018, now Pat. No. 10,502,534, which is a continuation of application No. 15/909,463, filed on Mar. 1, 2018, now Pat. No. 10,161,722.

(60) Provisional application No. 62/598,820, filed on Dec. 14, 2017.

(51) Int. Cl.
*F41H 13/00* (2006.01)

(52) U.S. Cl.
CPC ..... *F41H 13/0025* (2013.01)

(58) Field of Classification Search
CPC ..... F41H 13/0025
USPC ..... 42/1.08, 84; 361/232
See application file for complete search history.

(56) References Cited

U.S. PATENT DOCUMENTS

| | | | |
|---|---|---|---|
| 2,685,383 | A | 8/1954 | Kochner |
| 3,440,797 | A | 4/1969 | Spielman |
| 3,803,463 | A | 4/1974 | Cover |
| 4,253,132 | A | 2/1981 | Cover |

(Continued)

FOREIGN PATENT DOCUMENTS

| | | | |
|---|---|---|---|
| CN | 205957818 | U | 8/2016 |
| EP | 0849770 | A2 | 6/1998 |

(Continued)

OTHER PUBLICATIONS

IP Australia, Examination report No. 1 for Australian Application No. 2022202793 mailed Aug. 7, 2023.

(Continued)

*Primary Examiner* — Reginald S Tillman, Jr.
(74) *Attorney, Agent, or Firm* — Justin Powley

(57) ABSTRACT

A conducted electrical weapon ("CEW") impedes locomotion of a human target by providing a stimulus signal through the target via one or more electrodes. A propulsion system provides a force that launches the one or more electrodes toward the target to deliver the stimulus signal. The electrodes may be mechanically and electrically coupled to a deployment unit by a filament. An electrode may cooperate with a winding machine to wind the filament into a winding. The winding may be positioned inside the body of the electrode for deployment during launch.

20 Claims, 9 Drawing Sheets

(56) References Cited

U.S. PATENT DOCUMENTS

| | | | | |
|---|---|---|---|---|
| 5,831,199 | A | 11/1998 | McNulty et al. | |
| 6,161,598 | A | 12/2000 | Eder et al. | |
| 7,042,696 | B2 | 5/2006 | Smith et al. | |
| 7,234,262 | B2 | 6/2007 | Smith | |
| 7,327,549 | B2 | 2/2008 | Smith et al. | |
| 7,444,939 | B2 | 11/2008 | McNulty et al. | |
| 7,444,940 | B2 | 11/2008 | Kapeles et al. | |
| 7,950,329 | B1 | 5/2011 | Nemtyshkin et al. | |
| 7,984,676 | B1 | 7/2011 | Gavin et al. | |
| 8,837,107 | B2 | 9/2014 | Hinz | |
| 8,896,892 | B2 | 11/2014 | Wen | |
| 8,896,982 | B2 * | 11/2014 | Beechey | F41H 13/0018 102/504 |
| 9,435,619 | B1 | 9/2016 | Park | |
| 9,638,498 | B2 | 5/2017 | Chang | |
| 11,668,548 | B2 * | 6/2023 | Salisbury | F41H 13/0025 89/1.11 |
| 2005/0109200 | A1 | 5/2005 | McNulty | |
| 2006/0187610 | A1 | 8/2006 | Su | |
| 2006/0207466 | A1 | 9/2006 | McNulty | |
| 2006/0254108 | A1 | 11/2006 | Park | |
| 2006/0279898 | A1 | 12/2006 | Smith et al. | |
| 2007/0019357 | A1 | 1/2007 | Keely | |
| 2007/0214993 | A1 | 9/2007 | Cerovic et al. | |
| 2012/0019975 | A1 | 1/2012 | Hanchett et al. | |
| 2014/0233146 | A1 | 8/2014 | Gavin | |
| 2015/0002981 | A1 | 1/2015 | Klug et al. | |
| 2015/0153144 | A1 | 6/2015 | Cheatham et al. | |
| 2015/0329341 | A1 | 11/2015 | Wilder et al. | |
| 2016/0010956 | A1 | 1/2016 | Hanchett | |
| 2017/0258583 | A1 | 9/2017 | McCawley et al. | |

FOREIGN PATENT DOCUMENTS

| | | | |
|---|---|---|---|
| WO | 2011/011635 | A2 | 1/2011 |
| WO | 2012082012 | A2 | 6/2012 |
| WO | 2012128670 | A2 | 9/2012 |

OTHER PUBLICATIONS

Brazil Patent Office, Technical Examination Report for Brazil Application No. 1120200118095 mailed Sep. 12, 2023.
Taiwan Intellectual Property Office, TW IPO Office Action for Taiwan Patent Application No. 107108591 (translation provided).
Taiwan Intellectual Property Office, TW IPO Search Report for Taiwan Patent Application No. 107108591.
Taiwan Intellectual Property Office, TW IPO Allowance Decision for Taiwan Patent Application No. 107108591 date Jun. 24, 2019 (translation provided).
Taiwan Intellectual Property Office, TW IPO Office Action for Taiwan Patent Application No. 108126204 (translation provided).
Taiwan Intellectual Property Office, TW IPO Search Report for Taiwan Patent Application No. 108126204.
Taiwan Intellectual Property Office, TW IPO Allowance Decision for Taiwan Patent Application No. 108126204 (translation provided).
Taiwan Intellectual Property Office, TW IPO Office Action for Taiwan Patent Application No. 109108043 (translation provided).
Taiwan Intellectual Property Office, TW IPO Search Report for Taiwan Patent Application No. 109108043.
Taiwan Intellectual Property Office, TW IPO Allowance Decision for Taiwan Patent Application No. 109108043 (translation provided).
USPTO, Notice of Allowance and Fees Due for U.S. Appl. No. 15/909,463 mailed Sep. 12, 2018.
USPTO, Notice of Allowance and Fees Due for U.S. Appl. No. 16/189,576 mailed Apr. 23, 2019.
USPTO, Non-Final Office Action for U.S. Appl. No. 16/189,604 mailed May 8, 2019.
USPTO, Notice of Allowance and Fees Due for U.S. Appl. No. 16/189,604 mailed Aug. 9, 2019.
USPTO, Notice of Allowance and Fees Due for U.S. Appl. No. 16/672,194 mailed Jan. 2, 2020.
USPTO, Notice of Allowance and Fees Due for U.S. Appl. No. 16/672,216 mailed Feb. 19, 2020.
USPTO, Non-Final Office Action for U.S. Appl. No. 16/876,907 mailed Jul. 28, 2020.
USPTO, Notice of Allowance and Fees Due for U.S. Appl. No. 16/876,907 mailed Feb. 3, 2021.
Australian Government, IP Australia, Examination Report No. 1 for Australian Patent Application No. 2018385236 mailed Mar. 3, 2021.
Korean Intellectual Property Office, Decision for Grant of Patent for Korean Patent Application No. 10-2020-7020222 mailed Apr. 16, 2021.
Korean Patent Office, Decision to Grant for Korean Application No. 10-2021-7022626 mailed Apr. 19, 2022.
Australian Patent Office, First Examination Report for Australian Application No. 2020227116, Apr. 28, 2021, p. 1-3.
New Zealand Patent Office, First Examination Report for New Zealand Application No. 765753, May 6, 2021, p. 1-3.
Brazillian Patent Office, Search Report for Brazil Application No. 112020011809-5 mailed Jul. 4, 2022.
New Zealand Intellectual Property Office, Patent Examination Report 2 for New Zealand Application No. 765753 mailed Nov. 25, 2021.
Korean Intellectual Property Office, Notice of Grounds for Rejection for Korean Patent Application No. 10-2021-7022626, mailed Sep. 1, 2021.
European Property Office, Extended European Search Report for European Patent Application No. 18889362.2, mailed Sep. 8, 2021.
Brazil Patent Office, Technical Examination Report for Brazil Application No. BR112020011809-5 mailed Dec. 27, 2023.
Canadian Intellectual Property Office, Office Action for Canadian Application No. 3,085,549 mailed Feb. 20, 2024.
European Patent Office, Communication Pursuant to Article 94(3) EPC for European Application No. 18 889 362.2-1015 mailed Feb. 19, 2024.
European Patent Office, Communication under Rule 71(3) EPC for European Application No. 18889362.2 mailed Jun. 12, 2024.

* cited by examiner

ELECTRODE FOR A CONDUCTED ELECTRICAL WEAPON

CROSS-REFERENCE TO RELATED APPLICATIONS

This application is a continuation of, and claims priority to and the benefit of, U.S. patent application Ser. No. 17/245,376, filed on Apr. 30, 2021, and entitled "ELECTRODE FOR A CONDUCTED ELECTRICAL WEAPON"; which is a continuation of, and claimed priority to and the benefit of, U.S. patent application Ser. No. 16/876,907, now U.S. Pat. No. 11,022,409, filed on May 18, 2020, and entitled "ELECTRODE BODY FEATURES FOR A CONDUCTED ELECTRICAL WEAPON"; which is a continuation of, and claimed priority to and the benefit of, U.S. patent application Ser. No. 16/672,216, now U.S. Pat. No. 10,690,455, filed on Nov. 1, 2019, and entitled "ELECTRODE FOR A CONDUCTED ELECTRICAL WEAPON"; which is a continuation of, and claimed priority to and the benefit of, U.S. patent application Ser. No. 16/189,604, now U.S. Pat. No. 10,502,534, filed on Nov. 13, 2018, and entitled "SYSTEMS AND METHODS FOR A CANISTER WITH PRESSURE PASSAGES"; which is a continuation of, and claimed priority to and the benefit of, U.S. patent application Ser. No. 15/909,463, now U.S. Pat. No. 10,161,722, filed on Mar. 1, 2018, and entitled "SYSTEMS AND METHODS FOR AN ELECTRODE FOR A CONDUCTED ELECTRICAL WEAPON"; which claimed priority to and the benefit of U.S. Provisional Patent Application No. 62/598,820, filed on Dec. 14, 2017, and entitled "SYSTEMS AND METHODS FOR AN ELECTRODE FOR A CONDUCTED ELECTRICAL WEAPON". This application is further related to U.S. patent application Ser. No. 16/672,194, now U.S. Pat. No. 10,634,462, filed on Nov. 1, 2019, and entitled "SYSTEMS AND METHODS FOR WINDING A FILAMENT FOR AN ELECTRODE OF A CONDUCTED ELECTRICAL WEAPON"; and U.S. patent application Ser. No. 16/189,576, now U.S. Pat. No. 10,359,260, filed on Nov. 13, 2018, and entitled "SYSTEMS AND METHODS FOR A FLEXIBLE UNITARY MANIFOLD". All of the above-referenced applications are incorporated by reference in their entirety.

FIELD OF INVENTION

Embodiments of the present invention relate to conducted electrical weapons.

BRIEF DESCRIPTION OF THE SEVERAL VIEWS OF THE DRAWING

Embodiments of the present invention will be described with reference to the drawing, wherein like designations denote like elements, and.

DETAILED DESCRIPTION OF INVENTION

Figure 1:
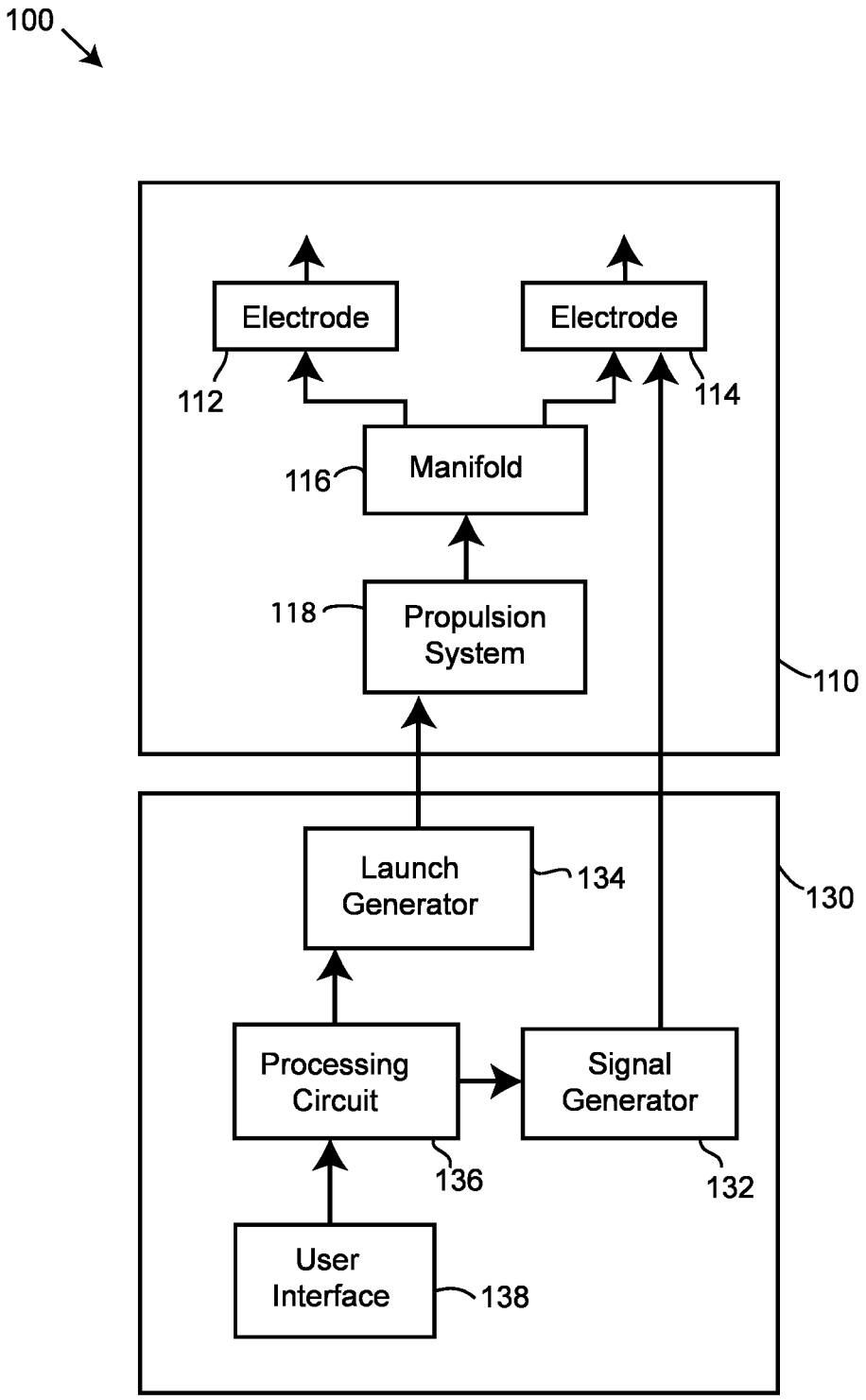
FIG. 1 is a block diagram of a conducted electrical weapon ("CEW") according to various aspects of the present disclosure.

A conducted electrical weapon ("CEW") is a device that provides a stimulus signal to a human or animal target to impede locomotion of the target. A CEW may include a handle and one or more removable deployment units (e.g., cartridges). A removable deployment unit inserts into a bay of the handle. A deployment unit may include one or more wire-tethered electrodes (e.g., darts) that are launched by a propellant toward a target to provide the stimulus signal through the target. A stimulus signal impedes the locomotion of the target. Locomotion may be inhibited by interfering with voluntary use of skeletal muscles and/or causing pain in the target. A stimulus signal that interferes with skeletal muscles may cause the skeletal muscles to lockup (e.g., freeze, tighten, stiffen) so that the target may not voluntarily move.

A stimulus signal may include a plurality of pulses of current (e.g., current pulses). Each pulse of current delivers a current (e.g., amount of charge) at a voltage. A voltage of at least a portion of a pulse may be of sufficient magnitude (e.g., 50,000 volts) to ionize air in a gap to establish a circuit to deliver the current of the pulse to a target. A gap of air may exist between an electrode (e.g., dart) and tissue of the target. Ionization of air in the gap establishes an ionization path of low impedance for delivery of the current to the target.

The stimulus signal is generated by a signal generator. The signal generator is controlled by a processing circuit, which also controls a launch generator. The processing circuit receives input from a user interface, and possibly information from other sources. The user interface may be as simple as a safety position (e.g., on/off) and a pull of a trigger to fire the weapon. An example of information from other sources may be a signal that indicates that a deployment unit is loaded into a bay in the handle and ready for use.

The processing circuit may send commands to the launch generator to launch one or more electrodes and/or engage the signal generator based on input received from the user interface or other possible sources. Upon receiving a launch command from the processing circuit, the launch generator controls the propulsion system to provide a force to launch one or more electrodes.

A force for launching one or more electrodes from a deployment unit may include release of a rapidly expanding gas. The force from the gas propels the one or more electrodes toward the target. As an electrode flies toward the target, the electrode deploys (e.g., extends) a wire-tether (e.g., filament, wire). The filament may be wound in a winding (e.g., coils). The winding may be positioned (e.g., stored) in the electrode. The winding of the filament may unravel (e.g., uncoil) to deploy the filament.

An electrode may land on or near a target. The filament then extends from the deployment unit that is inserted into the handle to the electrode positioned on or near the target. One end of the filament remains coupled to the deployment unit and through the deployment unit to a signal generator in the handle to deliver the current. The other end of the filament remains coupled to the electrode, or at least to a portion thereof (e.g., front, spear), to deliver the current to the target via the filament.

An electrode may include a spear. A spear may couple to target clothing or embed in target tissue to retain the electrode coupled to the target.

A filament is stored in a body of the electrode prior to deployment. A filament deploys from the winding through an opening (e.g., nozzle) in the back of the electrode. The end of the filament that couples to the electrode remains coupled before, during, and after launch and impact with the target. The end of the filament that is coupled to the deployment unit remains coupled to the deployment unit and through the deployment unit to the handle of the CEW while the deployment unit is inserted into the handle.

A filament may be wound into a winding and positioned in a body of the electrode during manufacture (e.g., assembly) of the electrode. While forming the winding, a body of the electrode may be separated from a front of the electrode. A front portion of the electrode may include a spear. A first end portion of the filament may extend through the body and out an opening in the rear of the body. A mandrel (e.g., spindle) may be inserted through the opening in the rear of the body. Filament from a spool of filament may be wound around the mandrel to form the winding. Once the winding has been formed, the wire from the spool may be cut to form a second end portion of the filament. The second end of the filament may be coupled to a front portion of the electrode. The mandrel may be extracted from the winding and from the body via the rear of the electrode. The body may be coupled to the front of the electrode so as to position (e.g., trapped, held, retained) the winding in a cavity of the body of the electrode.

During assembly of a deployment unit, the first end of the filament that extends from the rear of the electrode is coupled to the deployment unit.

A propulsion system may provide a force for launching one or more electrodes from a deployment unit. A propulsion system provides the force to propel one or more electrodes toward a target. A propulsion system may release a rapidly expanding gas to propel one or more electrodes. A propulsion system may receive a signal for launching (e.g., releasing the rapidly expanding gas) responsive to operation of a control (e.g., switch, trigger) of a user interface of the CEW. A propulsion system may include a pyrotechnic that ignites (e.g., burns) to release a compressed gas from a canister to launch the electrodes. The compressed gas from the canister rapidly expands to provide a force to launch the electrodes.

A manifold may transport (e.g., delivery, carry, direct) the rapidly expanding gas from the compressed gas to one or more electrodes to launch the electrodes from the deployment unit. A manifold may include structures (e.g., channels, guides, passages) for transporting a rapidly expanding gas from a source (e.g., burning pyrotechnic, canister of compress gas) of the rapidly expanding gas to the electrodes. A manifold may transport a rapidly expanding gas from the source to one or more bores that hold the one or more electrodes respectively. A manifold may be formed of a pliable material (e.g., silicone) to decrease an amount of expanding gas not transported (e.g., lost) prior to arrival at the bores and to improve manufacturability and assembly.

A canister (e.g., capsule) holds (e.g., retains) a compressed gas (e.g., air, nitrogen, inert). Release of the gas from the canister provides the force for propelling the one or more electrodes. A canister may be filled with a gas at a high pressure then sealed to retain the gas in the canister at the high pressure. Filling a canister may include placing a canister in a pressurized environment that contains the gas at the high pressure. The canister may include one or more openings that permit the passage of the gas from the environment into a cavity of the canister. The openings may be sealed to seal the gas in the canister. In an implementation, the canister includes a cavity having an opening. A lid is positioned in the opening. The lid is welded to the canister to seal the gas in the canister. The lid may include one or more notches to form openings between the lid and a body of the canister to permit the flow of gas from the environment into the cavity. The lid may be welded to the body. Welding the lid to the body seals the openings formed by the notches thereby retaining the gas in the canister.

CEW 100 of FIG. 1 performs the functions of a CEW and includes the structures as discussed above. CEW 100 includes deployment unit 110 and handle 130. Deployment unit 110 performs the function of a deployment unit and handle 130 performs the function of a handle as discussed above.

Deployment unit 110 includes propulsion system 118, manifold 116, electrode 112, and electrode 114. Propulsion system 118 performs the functions of a propulsion system as discussed above. Manifold 116 performs the functions of a manifold as discussed above. Electrodes 112 and electrode 114 perform the functions of an electrode as discussed above.

Handle 130 includes launch generator 134, processing circuit 136, signal generator 132, and user interface 138. Launch generator 134 and processing circuit 136 perform the functions of a launch generator and a processing circuit as discussed above. Signal generator 132 and user interface 138 perform the functions of a signal generator and a user interface as discussed above.

Although only deployment unit 110 is shown in FIG. 1, as discussed above, CEW 100 may cooperate with one or more deployment units 110 at the same time. One or more deployment units 110 may couple (e.g., insert into) handle 130 at the same time. Handle 130 may include one or more bays for respectively receiving one deployment unit 110.

Handle 130 may provide signals from signal generator 132 and/or launch generator 134 to deployment unit 110. A launch signal from launch generator 134 may cooperate with (e.g., instruct, initiate, control, operate) propulsion system 118 to launch electrodes 112 and 114 from deployment unit 110. A stimulus signal from signal generator 132 may be delivered (e.g., transported, carried) by electrodes 112 and 114 and their respective filaments to a human or animal target to interfere with locomotion of the target.

Handle 130 may have a form-factor for ergonomic use by a human user. A user may hold (e.g., grasp) handle 130. A user may manually operate user interface 138 to operate (e.g., control, initiate operation of) CEW 100. A user may aim (e.g., point) CEW 100 to direct the deployment of electrodes 112 and 114 toward a specific target.

A processing circuit includes any circuitry and/or electrical/electronic subsystem for performing a function. A processing circuit may include circuitry that performs (e.g., executes) a stored program. A processing circuit may include a digital signal processor, a microcontroller, a microprocessor, an application specific integrated circuit, a programmable logic device, logic circuitry, state machines, MEMS devices, signal conditioning circuitry, communication circuitry, a conventional computer, a conventional radio, a network appliance, data busses, address busses, and/or a combination thereof in any quantity suitable for performing a function and/or executing one or more stored programs.

A processing circuit may further include conventional passive electronic devices (e.g., resistors, capacitors, inductors) and/or active electronic devices (e.g., op amps, comparators, analog-to-digital converters, digital-to-analog converters, programmable logic). A processing circuit may include conventional data buses, output ports, input ports, timers, memory, and arithmetic units.

A processing circuit may provide and/or receive electrical signals whether digital and/or analog in form. A processing circuit may provide and/or receive digital information via a conventional bus using any conventional protocol. A processing circuit may receive information, manipulate the received information, and provide the manipulated information. A processing circuit may store information and retrieve stored information. Information received, stored, and/or manipulated by the processing circuit may be used to perform a function and/or to perform a stored program.

A processing circuit may control the operation and/or function of other circuits and/or components of a system. A processing circuit may receive data from other circuits and/or components of a system. A processing circuit may receive status information and/or information regarding the operation of other components of a system. A processing circuit may perform one or more operations, perform one or more calculations, provide commands (e.g., instructions, signals) to one or more other components responsive to data and/or status information. A command provided to a component may instruct the component to start operation, continue operation, alter operation, suspend operation, and/or cease operation. Commands and/or status may be communicated between a processing circuit and other circuits and/or components via any type of buss including any type of conventional data/address bus.

A processing circuit may include memory for storing data and/or programs for execution.

A launch generator provides a signal (e.g., launch signal) to a deployment unit. A launch generator may provide a launch signal to one or more propulsion systems of one or more deployment unit respectively. A launch signal may initiate (e.g., start, begin) operation of a propulsion system to launch one or more electrodes. A launch signal may ignite a pyrotechnic. A handle may include a connector for coupling one or more conductors from a launch generator to one or more deployment units while the deployment units are coupled to (e.g., inserted into) the handle. A launch generator may be controlled by and/or cooperate with a processing circuit to perform the functions of a launch generator. A launch generator may receive power for a power supply (e.g., battery) to perform the functions of a launch generator. A launch signal may include an electrical signal provided at a voltage. A launch generator may include circuits for transforming power from a power supply into a launch signal. A launch generator may include one or more transformers to transform a voltage from a power supply into a signal provided at a higher voltage.

A signal generator provides a signal. A signal that accomplishes electrical coupling and/or interference with locomotion of a target may be referred to as a stimulus signal. A stimulus signal may include a current provided at a voltage. A stimulus signal through target tissue may interfere with (e.g., impede) locomotion of the target. A stimulus signal may impede locomotion of a target through inducing fear, pain, and/or an inability to voluntary control skeletal muscles as discussed above.

A stimulus signal may include a one or more (e.g., series) of pulses of current. Pulses of a stimulus signal may be delivered at a pulse rate (e.g., 22 pps) for a period of time (e.g., 5 second). A signal generator may provide a pulse having a voltage in the range of 500 to 100,000 volts. A pulse of current may be provided at one or more magnitudes of voltage. A pulse may include a high voltage portion for ionizing gaps of air to electrically couple a signal generator to a target. A pulse provided at about 50,000 volts may ionize air in one or more gaps of up to one inch in series between a signal generator and a target. Ionizing of air in the one or more gap between a signal generator and a target establishes low impedance ionization paths for delivering a current from a signal generator to a target. After ionization, the ionization path will persist (e.g., remain in existence) as long as a current is provided via the ionization path. When the current provided by the ionization path ceases or is reduced below a threshold, the ionization path collapses (e.g., ceases to exist) and the electrode is no longer electrically coupled to target tissue. Ionization of air in one or more gaps establishes electrical connectivity (e.g., electrically couple) of a signal generator to a target to provide the stimulus signal to the target. A signal generator remains electrically coupled to a target as long as the ionization paths exist (e.g., persist).

A pulse may include a lower voltage portion (e.g., 500 to 10,000 volts) for providing current through target tissue to impede locomotion of the target. A portion of a current used to ionize gaps of air to establish electrical connectivity may also contribute to the current provided through target tissue to impede locomotion of the target.

A pulse of a stimulus signal may include a high voltage portion for ionizing gaps of air to establish electrical coupling and a lower voltage portion for providing current through target tissue to impede locomotion of the target. Each pulse of a stimulus signal may be capable of establishing electrical connectivity of a signal generator with a target and providing a current to interfere with locomotion of the target.

A signal generator includes circuits for receiving electrical energy (e.g., power supply, battery) and for providing the stimulus signal. Electrical/electronic components in the circuits of a signal generator may include capacitors, resistors, inductors, spark gaps, transformers, silicon controlled rectifiers, and analog-to-digital converters. A processing circuit may cooperate with and/or control the circuits of a signal generator to produce a stimulus signal.

A user interface provides an interface between a user and a CEW. A user may control, at least in part, a CEW via the user interface. A user may provide information and/or commands to a CEW via a user interface. A user may receive information and/or responses from a CEW via the user interface. A user interface may include one or more controls (e.g., buttons, switches) that permit a user to interact and/or communicate with a device to control (e.g., influence) the operation (e.g., functions) of the device. A user interface of a CEW may include a trigger. A trigger may initiation an operation (e.g., firing, providing a current) of a CEW.

A propulsion system provides a force. A force may launch one or more electrodes from a deployment unit. A rapidly expanding gas may provide a force for launching one or more electrodes. A burning pyrotechnic may provide a rapidly expanding gas. Release of a pressurized gas from a canister may provide a rapidly expanding gas. In one implementation, the propulsion system contains a canister of highly pressurized gas. A rapidly expanding gas from a pyrotechnic operates to release the pressurized gas from the canister to launch the one or more electrodes. A propulsion system may provide the force needed to launch one or more electrodes.

A manifold (e.g., channel, passage) may direct (e.g., transfer, transport) a force of the rapidly expanding gas from the source of the rapidly expanding gas to the one or more electrodes to launch the electrodes.

A launch generator may cooperate with a propulsion system to launch one or more electrodes. A launch generator may provide a signal to a propulsion system. A signal may initiate (e.g., begin, start) an operation of the propulsion system to launch one or more electrodes. A signal from a launch generator may be referred to as a launch signal. A launch signal may ignite a pyrotechnic.

A force of rapidly expanding gas from the pyrotechnic may rupture (e.g., open) a canister filled with a compressed gas. The ruptured canister quickly releases a rapidly expanding gas. A manifold transports the rapidly expanding gas from the canister to the rear of one or more electrodes. The force delivered to the rear of the one or more electrodes accelerates the electrodes away from the deployment unit toward a target.

An electrode is propelled (e.g., launched) from a deployment unit toward a target. An electrode couples to a filament. A signal generator may provide a stimulus signal to a target via a filament that is electrically coupled to a filament. An electrode may include any aerodynamic structure to improve accuracy of flight toward the target. An electrode may include structures (e.g., spear, barbs) for mechanically coupling the electrode to a target. Movement of an electrode out of a deployment unit toward a target deploys (e.g., pulls) the filament coupled to the electrode. The filament extends from the cartridge in the handle to the electrode at the target. An electrode may be formed in whole or part of a conductive material for delivery of the current into target tissue. The filament is formed of a conductive material. A filament may be insulated or uninsulated.

A deployment unit of a CEW may include one or more electrodes. A deployment unit may include a manifold and/or a propulsion system. A propulsion system may include a canister and a pyrotechnic. A canister may hold a pressurized gas. A propulsion system, a manifold, a canister, a pyrotechnic may perform the functions of a propulsion system, a manifold, a canister, a pyrotechnic respectively discussed above.

A deployment unit may couple to (e.g., attach to, plug into, insert into) a handle. A deployment unit may be decoupled (e.g., detached) and separated (e.g., removed) from the handle. A deployment unit may be decoupled from a handle after a use (e.g., launch electrodes, deliver current) of the deployment unit. A used deployment unit may be replaced with an unused deployment unit and coupled to the handle. Coupling a deployment unit to a handle mechanically and electrically couples the deployment unit to the handle. Electrically coupling a deployment unit to a handle enables the deployment unit to communicate with the handle. Communication includes providing and/or receiving control signals (e.g., launch signal), stimulus signals, and/or information.

Figure 2:
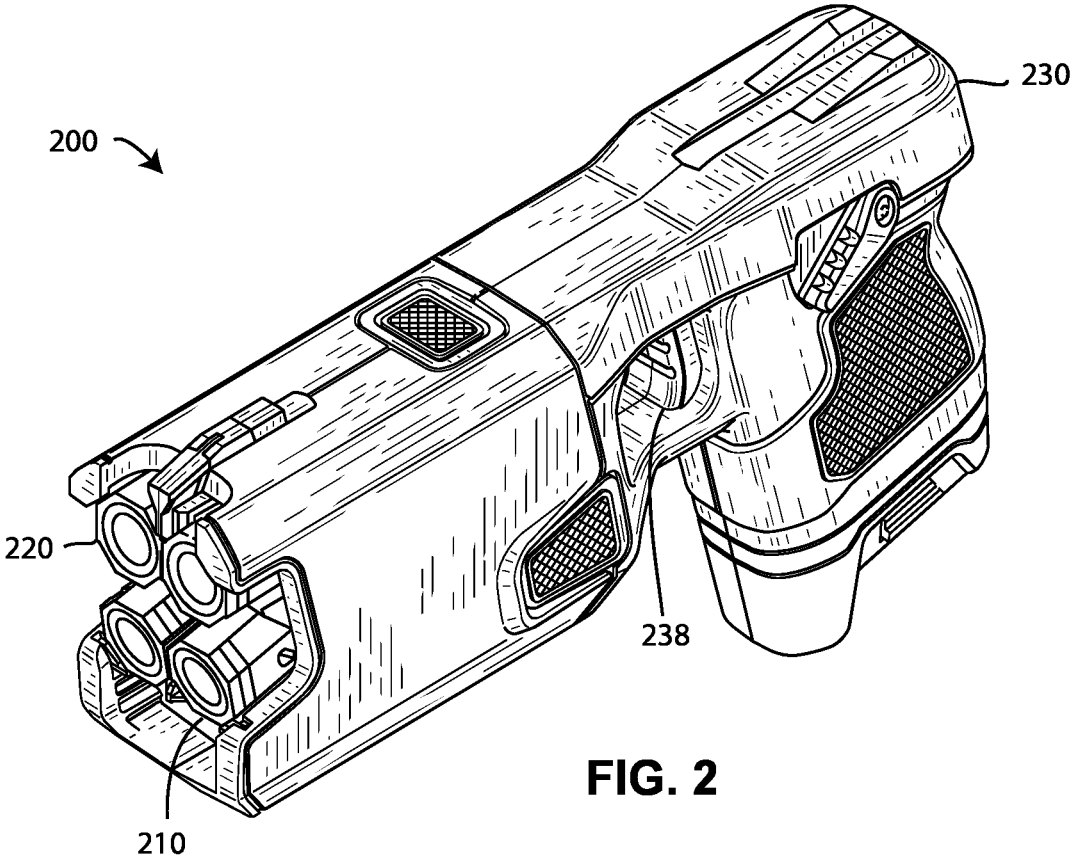
FIG. 2 is a diagram of an implementation of a CEW.

CEW 200, in FIG. 2, is an implementation of CEW 100. CEW 200 includes handle 230, deployment unit 210, and deployment unit 220. Deployment unit 210 and 220 are inserted into handle 230. Handle 230 includes trigger 238.

Handle 230 perform the functions of a handle discussed above. Deployment unit 210 and 220 perform the functions of a deployment unit discussed above. Trigger 238 performs the functions of a trigger discussed above.

Figure 3:
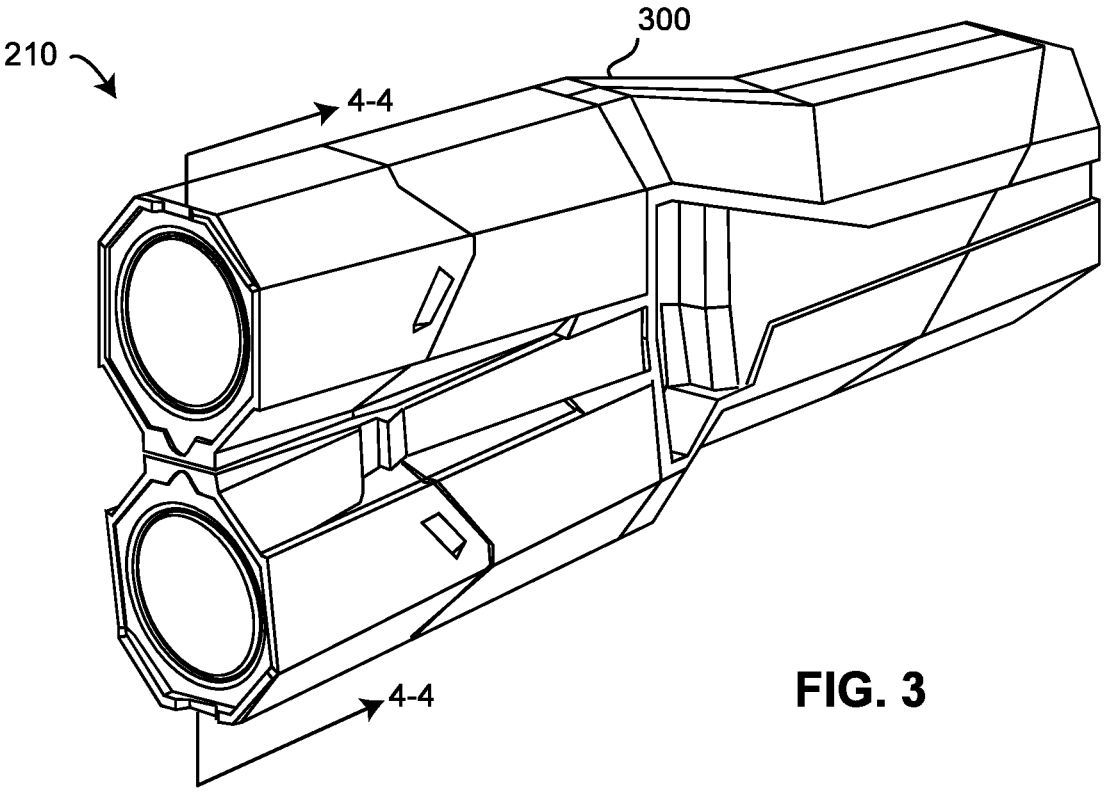
FIG. 3 is a diagram of an implementation of a deployment unit.
Figure 4:
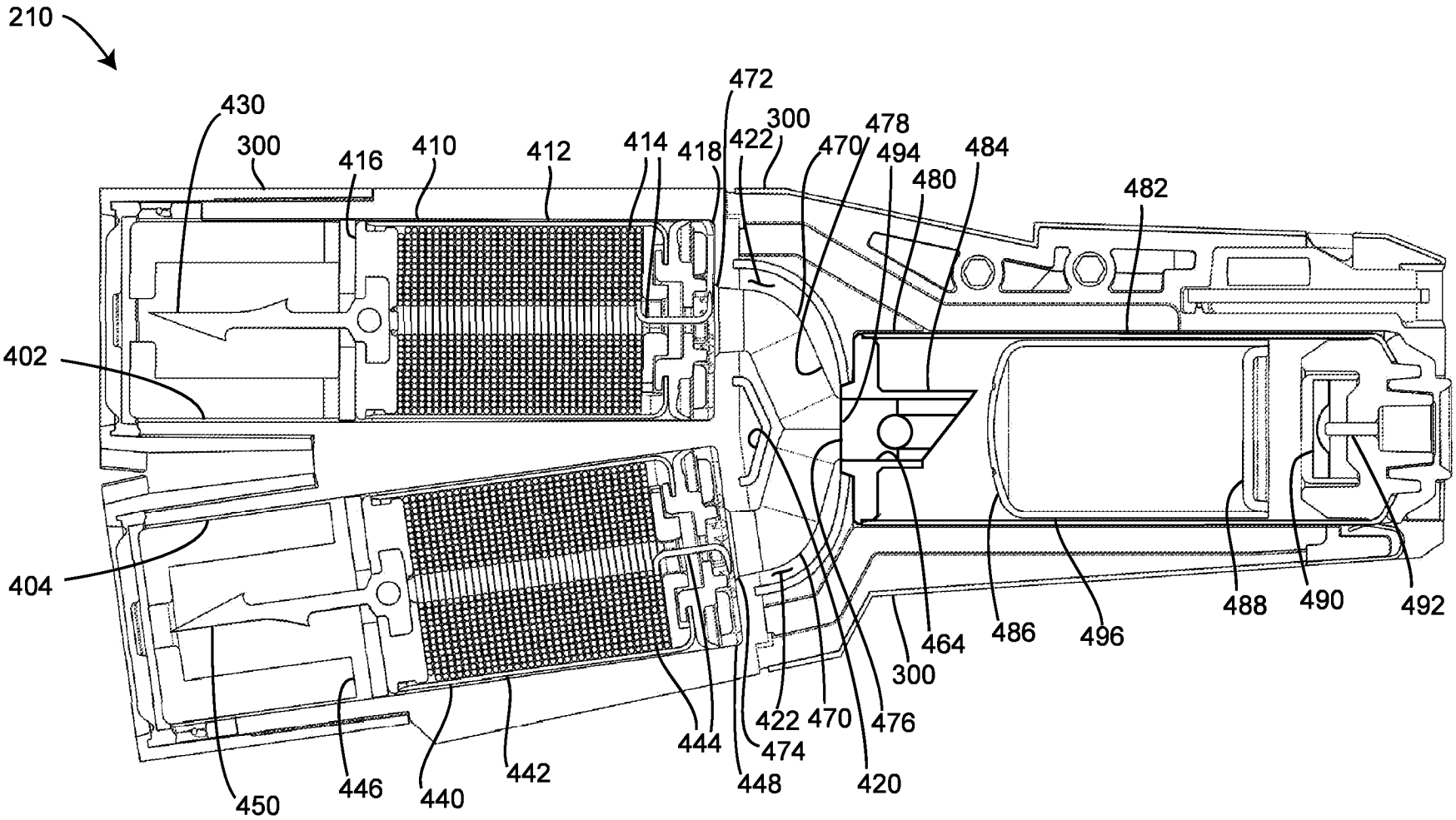
FIG. 4 is a cross-section of the deployment unit of FIG. 3 along axis 4-4.

The deployment unit of FIGS. 3 and 4 is deployment unit 210 decoupled from handle 230. Deployment unit 210 includes housing 300, electrode 410, electrode 440, manifold 470, and propulsion system 480. Electrode 410 and 440 perform the functions of an electrode discussed above. Manifold 470 and propulsion system 480 perform the functions of a manifold and a propulsion system respectively discussed above.

Housing 300 includes bore 402 and bore 404. Electrode 410 includes body 412, filament 414, front wall 416, rear wall 418, and spear 430. Electrode 440 includes body 442, filament 444, front wall 446, rear wall 448, and spear 450. Manifold 470 includes outlet 472, outlet 474, inlet 476, channel 478, wall 420, and wall 422. Propulsion system 480 includes housing 482, anvil 484, canister 486, lid 488, pyrotechnic 490, conductor 492, and outlet 494. Anvil 484, canister 486, lid 488, pyrotechnic 490, and conductor 492 are positioned in housing 482.

Deployment unit 210 cooperates with handle 230 to launch electrodes 410 and 440 toward a target to provide a stimulus signal to the target. A launch generator (e.g., 134) of handle 230 provides a launch signal to conductor 492 of propulsion unit 480 to launch electrodes 410 and 440. Launch generator 134 electrically couples to conductor 492 of deployment unit 210. Electrical coupling may be accomplished by ionization of air in a gap between launch generator 134 and conductor 492. Conductor 492 transmits (e.g., carries, delivers) the launch signal to pyrotechnic 490 via conductor 492.

The launch signal ignites pyrotechnic 490. A rapidly expanding gas produced by the burning (e.g., ignition) of pyrotechnic 490 applies a force to canister 486. The force moves canister 486 toward anvil 484. The force presses canister 486 against anvil 484 thereby piercing (e.g., rupturing, opening) canister 486. Piercing canister 486 releases a compressed gas held in canister 486. The compressed gas exits canister 486 and enters into a passage of anvil 484. The passage of anvil 484 carries (e.g., directs, guides) the now rapidly expanding compressed gas from canister 486 to outlet 494 of propulsion system 480.

The rapidly expanding gas enters inlet 476 of manifold 470. The rapidly expanding gas from outlet 494 travels along channel 478 to outlet 472 and outlet 474. The rapidly expanding gas exits outlet 472, enters bore 402, and applies a force on electrode 410 which propels (e.g., launches) electrode 410 from bore 402 toward a target. The rapidly expanding gas exits outlet 474, enters bore 404, and applies a force on electrode 440 which propels (e.g., launches) electrode 440 from bore 404 toward the target.

The rapidly expanding gas entering from the manifold outlet 472 launches electrode 410 forward out of bore 402.

Electrode 410 exits bore 402 flying toward a target. As electrode 410 travels toward the target, filament 414 stored within body 412 deploys through an opening in rear wall 418. One end portion of filament 414 is mechanically coupled to the front of deployment unit 210.

When electrode 410 reaches the target, spear 430 couples to (e.g., enmeshes in, entangles in, attaches to) the target's clothing (e.g., garments, apparel, outerwear) or pierces and embeds into target tissue to mechanically couple to the target. Signal generator 132 may electrically couple to the target through electrode 410 via deployed filament 414.

As with electrode 410, the rapidly expanding gas exits manifold outlet 474 into bore 404 to launch electrode 440 out of bore 404. Electrode 440 exits bore 404 and flies toward the target. As electrode 440 travels toward the target, filament 444 stored within body 442 deploys through an opening in rear wall 448. One end portion of filament 444 is mechanically coupled to the front of deployment unit 210. Spear 450 may mechanically couple electrode 440 to target clothing or embed into target tissue. Signal generator 132 may electrically couple to the target via electrode 440 and deployed filament 444.

Signal generator 132 may provide a stimulus signal through target tissue via filament 414, electrode 410, target tissue, electrode 440, and filament 444. A high voltage stimulus signal ionizes air in any gaps to electrically coupled signal generator 132 to the target. Stimulus signal generator 132 may provide a stimulus signal through the electrical circuit established with the target to impede locomotion of the target.

Figure 5:
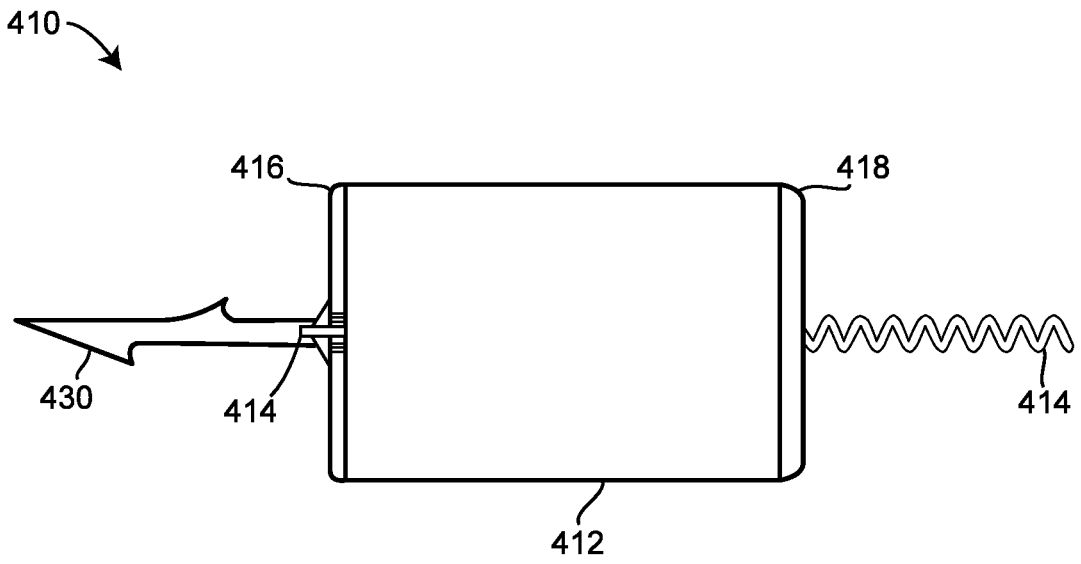
FIG. 5 is a side view of an implementation of an electrode according to various aspects of the present disclosure.
Figure 6:
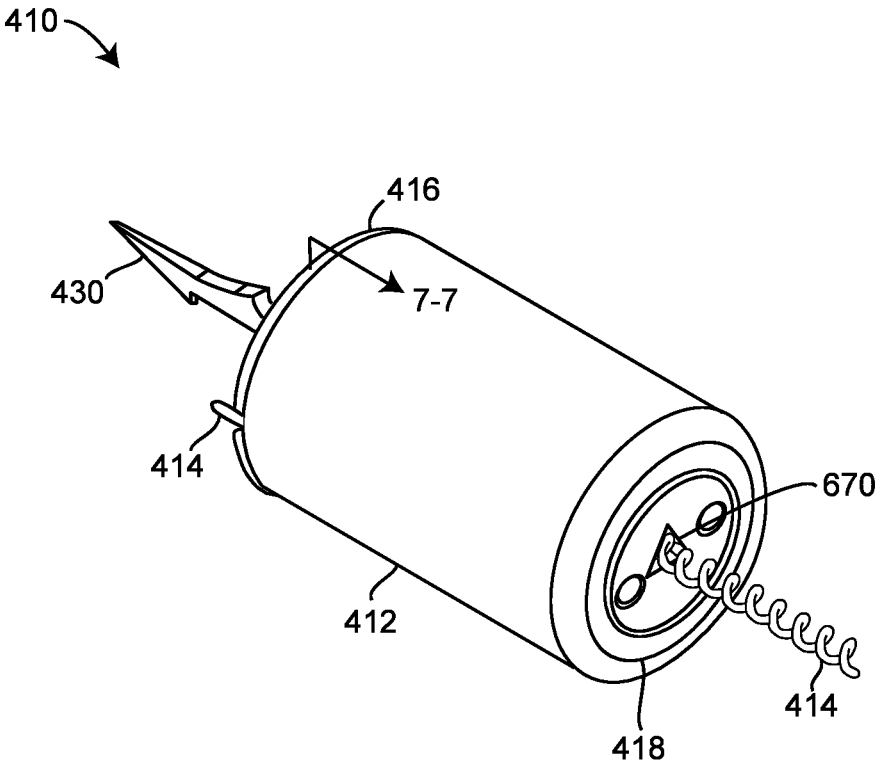
FIG. 6 is a perspective view of the electrode of FIG. 5 showing a rear portion of the electrode.
Figure 7:
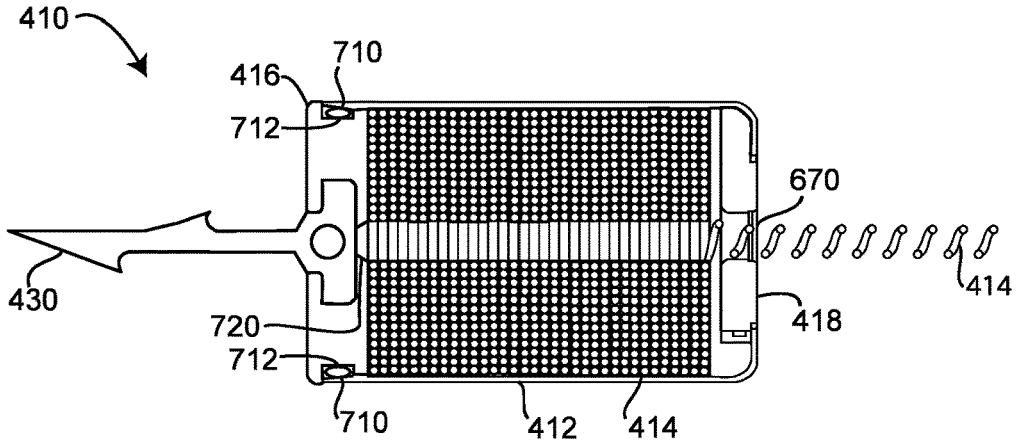
FIG. 7 is a cross-section of the electrode of FIG. 6 along axis 7-7.
Figure 8:
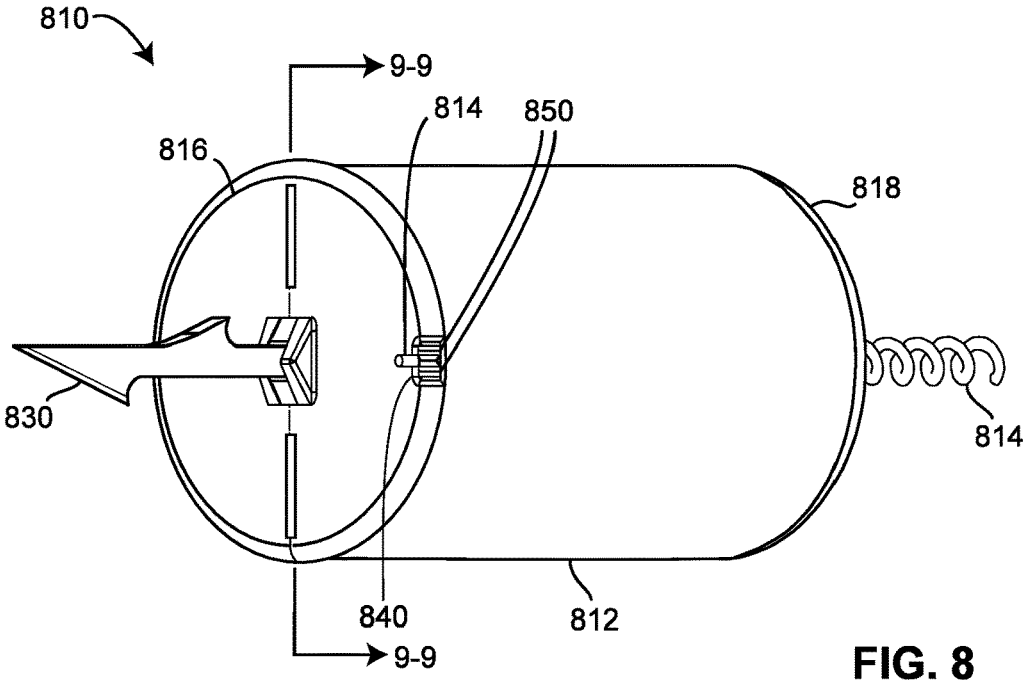
FIG. 8 is a perspective view of another implementation of an electrode showing a front portion of the electrode.
Figure 9:
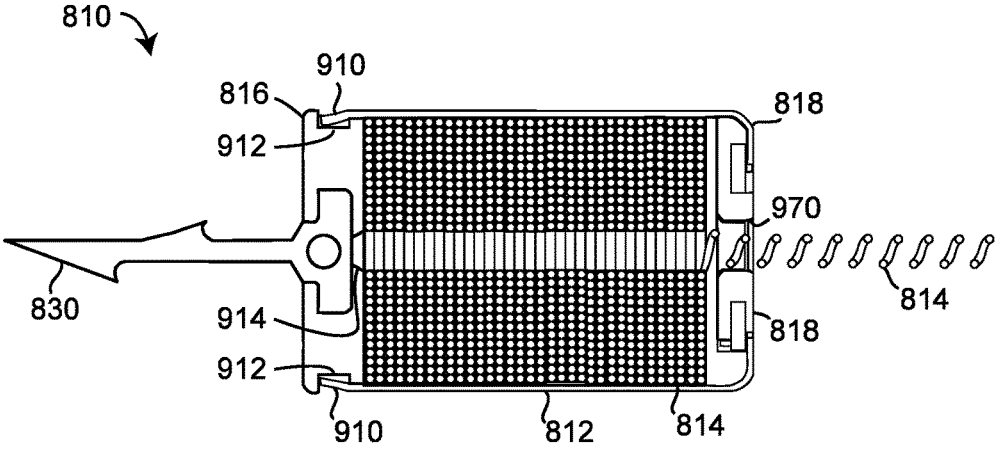
FIG. 9 is a cross-section of the electrode of FIG. 8 along axis 9-9.
Figure 10:
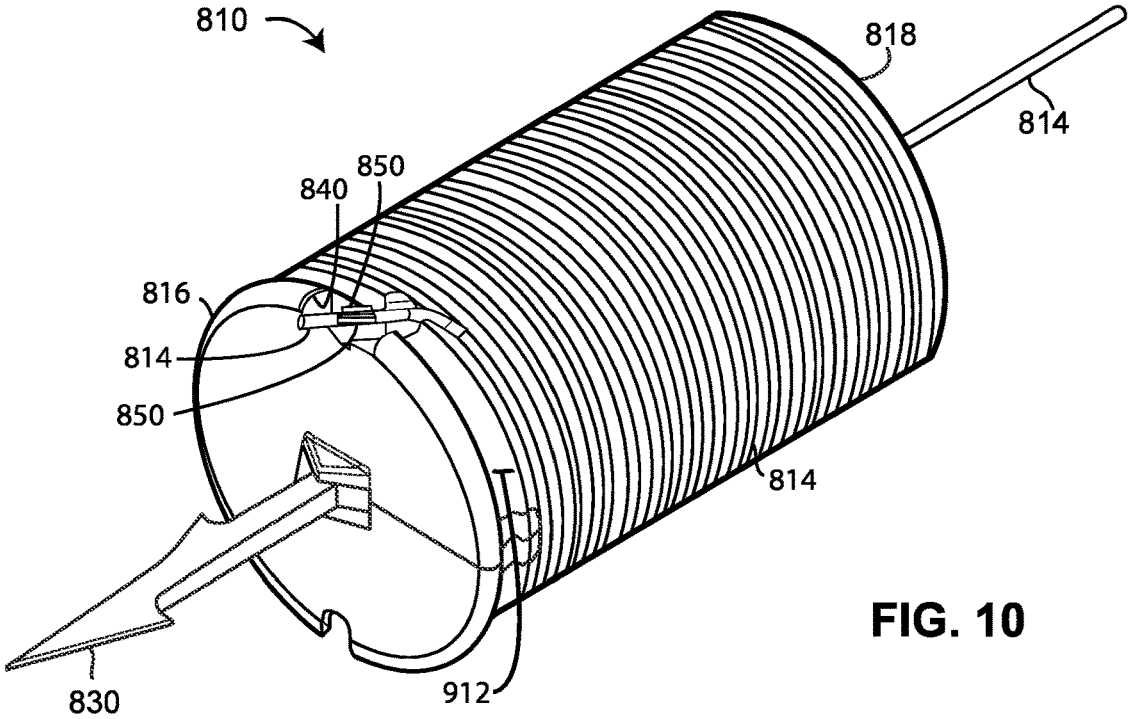
FIG. 10 is a perspective view of the electrode of FIG. 8 with the body of the electrode removed.
Figure 11:
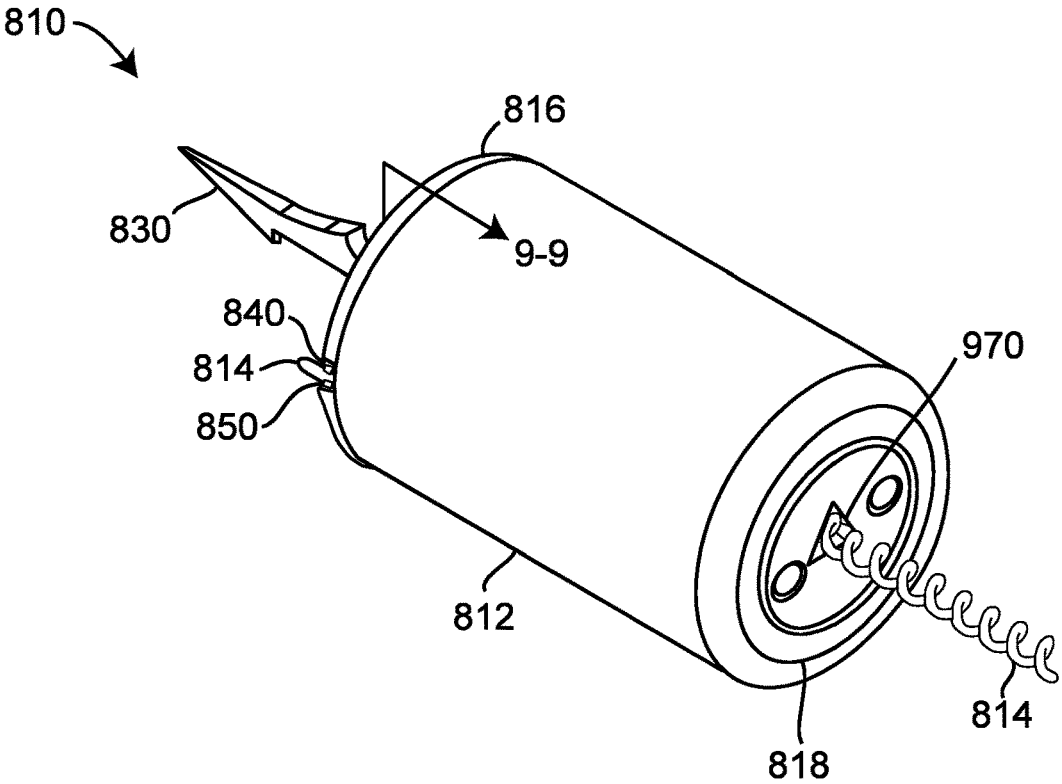
FIG. 11 is a perspective view of the electrode of FIG. 8 showing a rear portion of the electrode.

An implementation of electrode 410 is shown in FIGS. 5-7. Electrode 410 includes body 412, front wall 416, rear wall 418, opening 670, filament 414, spear 430, groove 712, band 710, and recess 720. Electrode 410 performs the function of an electrode discussed above.

Filament 414 is wound into a winding. The winding of filament 414 is stored (e.g., stowed) within body 412. A first end portion of filament 414 mechanically couples to electrode 410. The first end portion is held (e.g., pressed, retained, compressed, squeezed, pinched) between front wall 416 and body 412. The first end portion of filament 414 extends forward of front wall 416. The first end portion and filament 414 do not electrically couple to body 412 or spear 430. When spear 430 is proximate to or imbedded into target tissue, a high voltage stimulus signal ionizes the air in a gap between the first end portion of filament 414 and spear 430, front wall 416, or body 412 to providing a current to the target. Spear 430, front wall 416, and body 412 may be formed of a metal to conduct the stimulus signal.

A second end portion of filament 414 extends through opening 670 in rear wall 418 and mechanically couples to deployment unit 210. The second end portion remains coupled to deployment unit 210 before, during and after launching electrode 410. Filament 414 deploys from the winding in body 412 though opening 670 as electrode 410 travels away from deployment unit 210 toward a target.

Front wall 416 includes groove 712. Groove 712 may encircle all or a part of the circumference of front wall 416. Band 710 is positioned in groove 712. Band 710 encircles at least a portion of front wall 416. Band 710 couples to front wall 416 in groove 712. Spear 430 mechanically couples to front wall 416. Body 412 may be formed of a metal. In an implementation body 412 is formed of aluminum. Body 412 is positioned around front wall 416 and around band 710. Front wall 416 may be formed of a metal. In an implementation front wall 416 is formed of zinc. Body 412 couples to band 710 which couples front wall 416 to body 412. Band 710 may be formed of a metal. In an implementation, body 412 is welded to band 710 to couple body 412 to front wall 416.

Body 412 remains coupled to band 710 and band 710 to front wall 416 before, during, and after launch of electrode 410. Body 412 remains coupled to band 710 and band 710 to front wall 416 before, during, and after impact of electrode 410 with a target.

Rear wall 418 mechanically couples to body 412. In an implementation, rear wall 418 is positioned in the rear open end of cylindrical body 412. Rear wall 418 may be coupled to body 412 using any conventional coupling (e.g., glue, interference).

A second implementation of an electrode is shown in FIGS. 8-11. Electrode 810 includes body 812, front wall 816, rear wall 818, and filament 814. Front wall 816 includes channel 840, retainer 850, spear 830, groove 912, and recess 914. Rear wall 818 includes opening 970 (e.g., nozzle). Body 812 is deformed to form crimp 910. Crimping body 812 provides a force to mechanically couple (e.g., bind) body 812 to front wall 816. Electrode 810 performs the function of an electrode discussed above.

Filament 814 is wound into a winding. The winding of filament 814 is stored (e.g., stowed) within body 812. A first end portion of filament 814 passes through channel 840 and extends forward of front wall 816. A first end portion of filament 814 mechanically couples to retainer 850. Retainer 850 is positioned in channel 840 and mechanically couples to front wall 816. The first end portion is held (e.g., pressed, retained, compressed, squeezed, pinched) in retainer 850.

The structure and function of a retainer 850 may be performed by one or more walls of channel 840. A filament may be placed in channel 840. Channel 840 includes one or more walls. Filament 814 is positioned between the one or more walls to extend forward of front wall 816. One or more walls of channel 840 may be deformed (e.g., bend, crimped, squished) so that the one or more walls come into contact with filament 814 to retain filament 814 in channel 840. For example, channel 840 may have a "U" shape such that filament 814 lies in the lower portion of the "U" shape and the upper portion of the "U" shape are pushed together to close the exit from channel 840.

The first end portion of filament 814 is not electrically coupled to body 812 or spear 830. When spear 830 is proximate to or imbedded into target tissue, a high voltage stimulus signal ionizes air in a gap between the first end portion of filament 814 and spear 830, front wall 816, and/or body 812 to provide a current to the target. Spear 830, front wall 816, and body 812 may be formed of a metal to conduct the stimulus signal.

A second end portion of filament 814 extends through opening 970 in rear wall 818 and mechanically couples to deployment unit 210. The second end remains coupled to deployment unit 210 before, during and after launching electrode 810. Filament 814 deploys from the winding in body 812 though opening 970 as electrode 810 travels away from deployment unit 210 toward a target.

Spear 830 mechanically couples to front wall 816. When electrode 810 reaches a target, spear 830 couples to target clothing or pierces and embeds into target tissue to mechanically couple spear 830 to the target. In some instances, impact of electrode 810 with a target causes the body of electrode 810 to pivot around the location where spear 830 is mechanically coupled to or embedded into the target. A force of the angular momentum caused by the pivoting of electrode 810 and/or a recoil force may decouple body 812 from front wall 816. Decoupling body 812 from front wall 816 leaves spear 830 coupled to the target while the force of the angular momentum overcomes the binding force of crimp 910 from groove 912, and body 812 and the remaining winding are thrown (e.g., moved) away from front wall 816 and the target. Retainer 850 retains filament 814 coupled to front wall 816 before, during, and after impact of electrode 810 with the target and separation of body 812 from front wall 816.

Impact of electrode 810 pushes spear 830 into target clothing and/or tissue. The separation of body 812 and the winding from front wall 816 reduces a likelihood that the angular momentum or a force of impact may decouple spear 830 from the target.

Rear wall 818 mechanically couples to body 812. In an implementation, rear wall 818 is positioned in the rear open end of cylindrical body 812. Rear wall 818 may be coupled to body 812 using any conventional coupling.

A winding of a filament may be formed for insertion into and storage in the body of an electrode. Winding a filament may position a first end portion of a filament proximate to a front wall of an electrode for coupling to the front wall or between the front wall and the body as discussed above. Winding a filament may position a second end portion of a filament so that the second end portion extends through an opening in a rear wall of an electrode for coupling to a deployment unit.

During winding, a front wall of the electrode is positioned a distance forward of the body of the electrode. The rear wall of the electrode is coupled to the body. A mandrel of the winding machine may extend through the opening in the rear wall and extend forward until an end portion of the mandrel is inserted into a recess in the front wall. The filament may be wound around the mandrel in the space between the front wall and the body to form the winding. Once the winding is formed, the winding may be moved by the mandrel into the cavity of the body. As the mandrel moves the winding into the body, the front wall moves toward the body. As the winding is positioned in the body, the front wall is positioned with respect to the body for coupling the body to the front wall.

The mandrel may be extracted from the winding via the opening in the rear wall, thereby leaving the winding positioned in the body of the electrode. The first end portion of the filament may be coupled to a retainer for coupling the filament to the electrode or the first end portion of the filament may be held between the front wall and the body.

The body may be coupled to the front wall to complete assembly of the filament.

Figure 12:
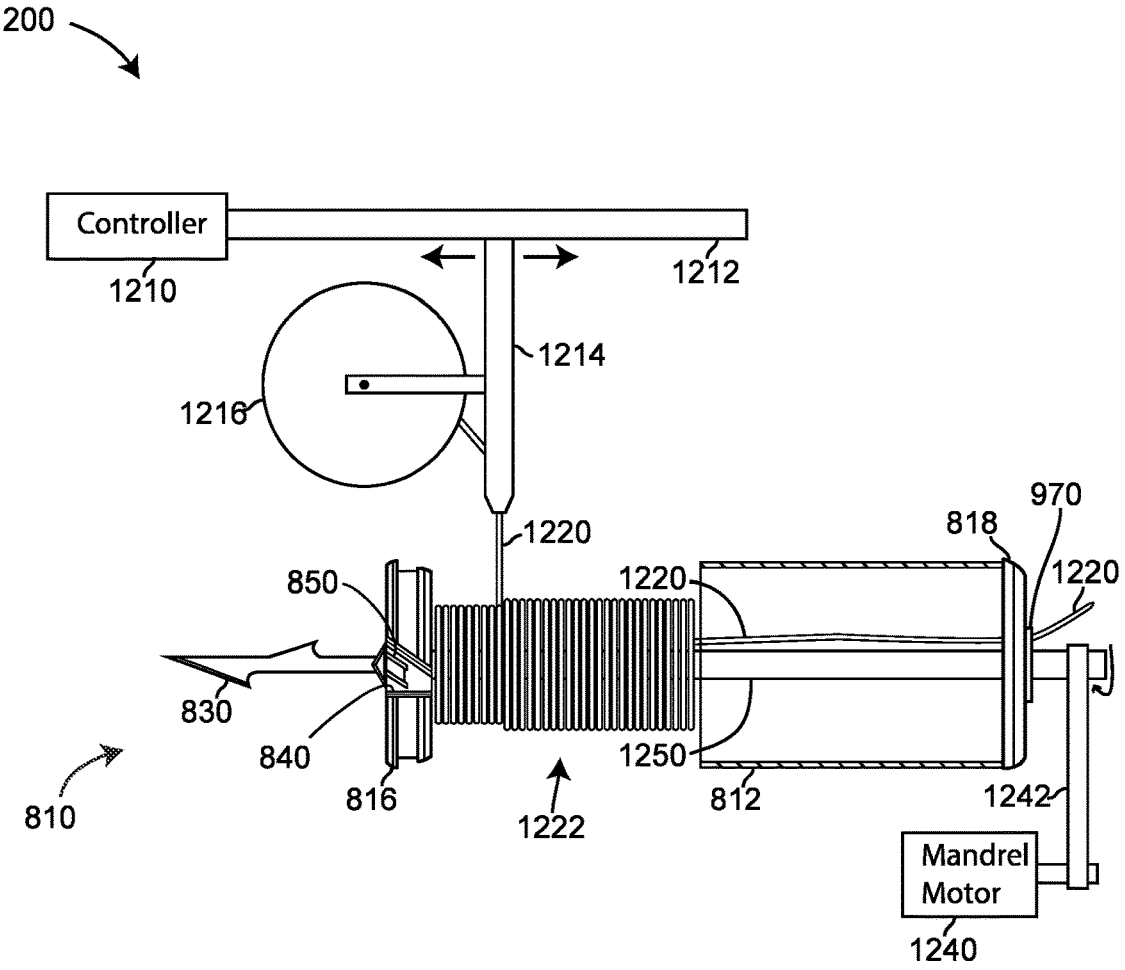
FIG. 12 is a depiction of a machine and an electrode in the process of forming a winding.
Figure 13:
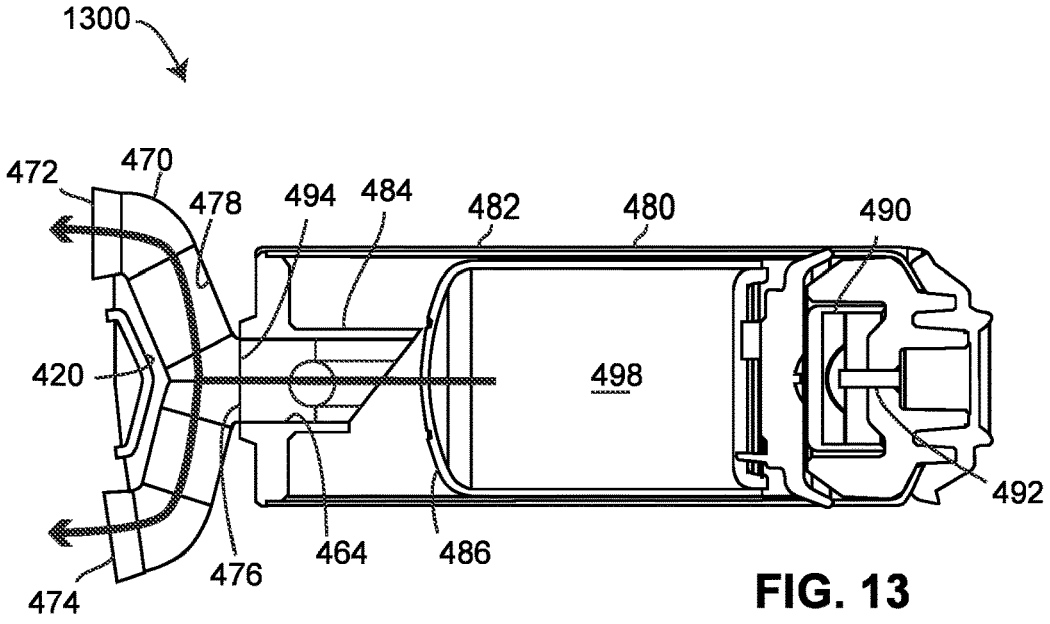
FIG. 13 is a cross-section of the propulsion system and manifold of FIG. 4.
Figure 14:
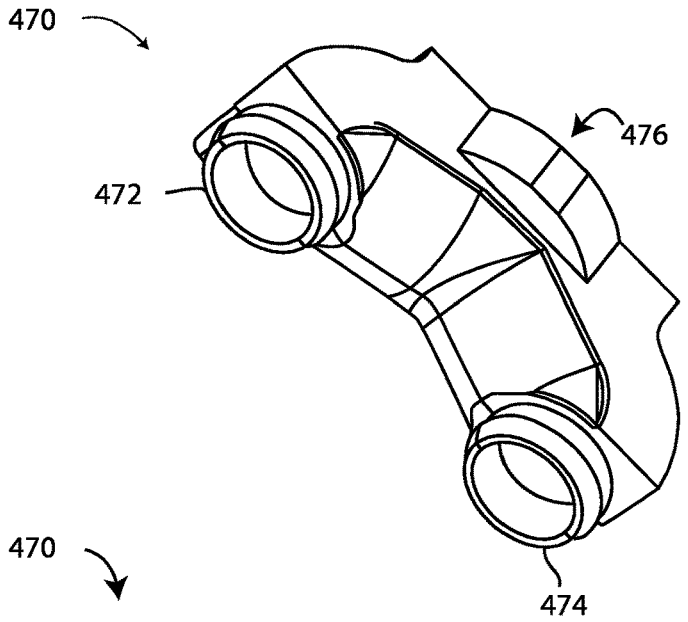
FIG. 14 is a perspective view of an implementation of a manifold showing the outlets of the manifold.
Figure 15:
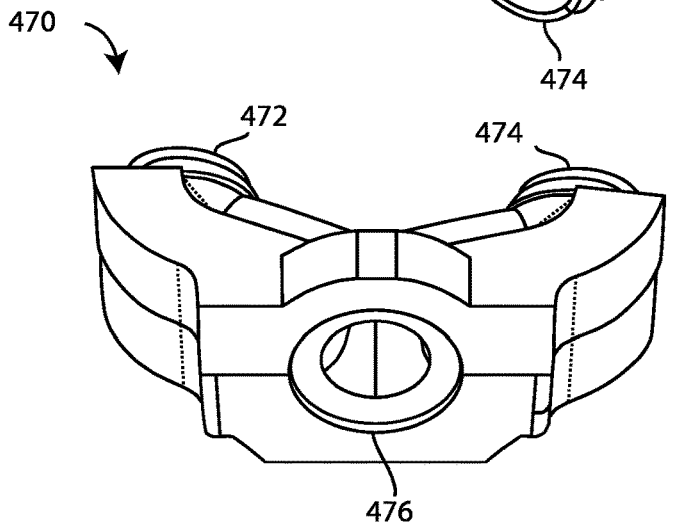
FIG. 15 is a perspective view of the manifold of FIG. 14 showing an inlet of the manifold.
Figure 16:
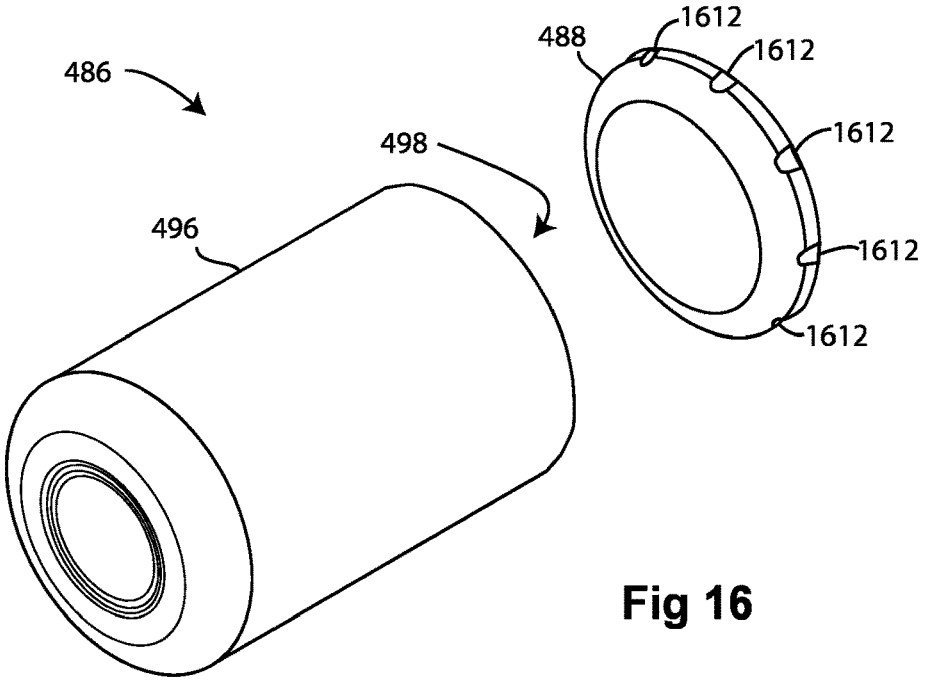
FIG. 16 is a perspective view of an implementation of the canister of FIG. 4 showing the front of the canister with the lid removed.
Figure 17:
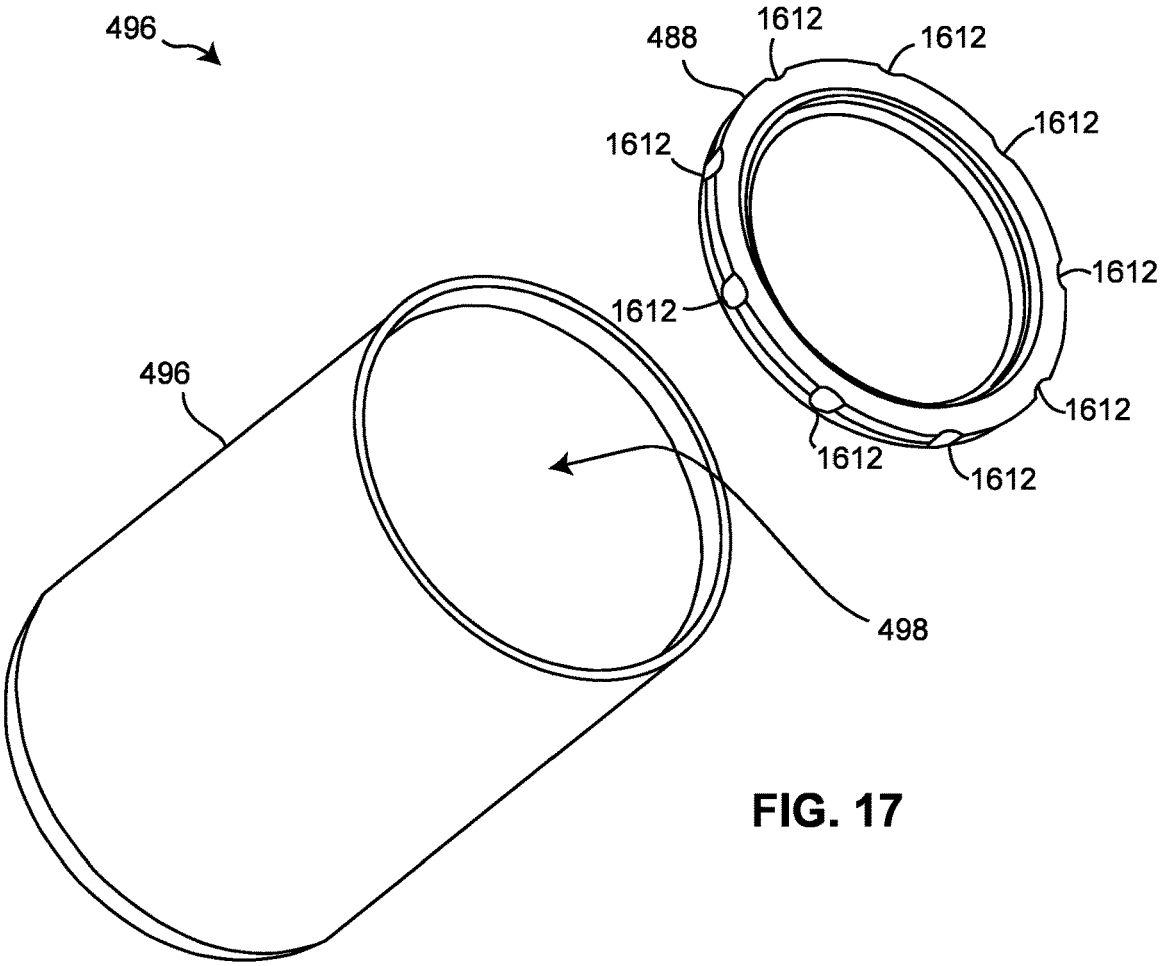
FIG. 17 is a perspective view of the canister of FIG. 16 showing the rear of the canister with the lid removed.
Figure 18:
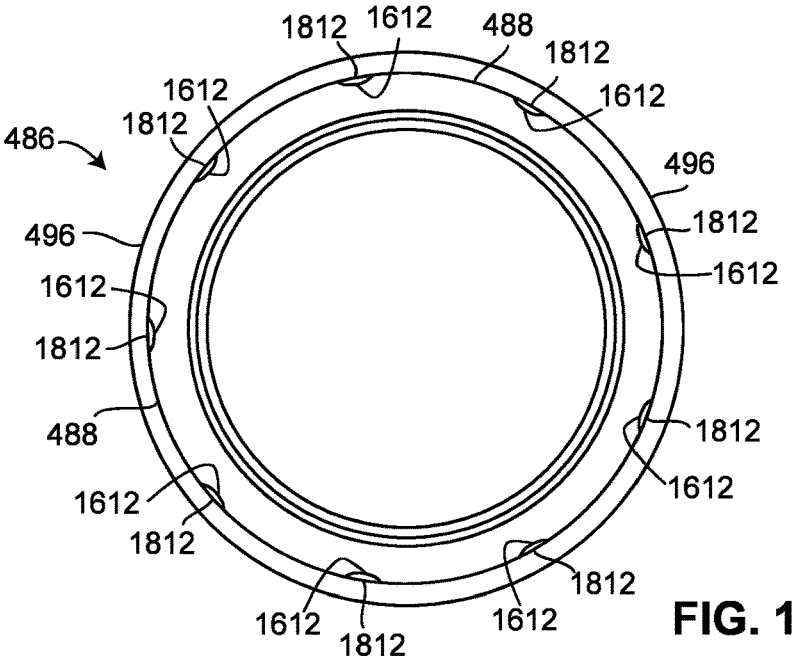
FIG. 18 is a rear view of the canister of FIG. 16 with the lid inserted into the canister.

Machine 1200 winds filament 1220 into winding 1222 of electrode 810. Machine 1200 includes an apparatus to hold and rotate electrode 810 and an apparatus that supplies filament 1220 for the winding process. The apparatus that rotates electrode 810 includes mandrel 1250, belt 1242, and motor 1240. The apparatus that supplies filament 1220 includes spool 1216, arm 1214, worm gear 1212, and controller 1210. Electrode 810 includes front wall 816, spear 830, filament 1220, winding 1222, body 812, rear wall 818, and rear wall opening 970. During the winding process, body 812 is separated from front wall 816. Mandrel 1250 is extended through opening 970 of rear wall 818 and extended forward until an end portion of mandrel 1250 is positioned in recess 914 of front wall 816. FIG. 12 depicts front wall 816, body 812, rear wall 818, filament 1220, and winding 1222 of electrode 810 positioned with respect to mandrel 1250 and winding machine 1200 during the winding process.

A process for winding a filament into an electrode includes:

1. Pull a first end portion of filament 1220 from spool 1216 through arm 1214;
2. Thread the first end portion of filament 1220 rearward through body 812 and opening 970 of rear wall 818;
3. Insert mandrel 1250 through opening 970 in rear wall 818 past the first end portion of the filament 1220 such that mandrel 1250 extends through body 812 and inserts into recess 914 of front wall 816;
4. Position body 812 away from front wall 816 to expose mandrel 1250 between front wall 816 and body 812;
5. Position arm 1214, possibly by operating controller 1210, at a rear-most position relative to front wall 816. The rear-most position is a distance from front wall 816 to the position where rear wall 818 will be positioned after body 812 is coupled to front wall 816;
6. Motor 1240 rotates mandrel 1250 via belt 1242 and filament 1220 winds around mandrel 1250 as mandrel 1250 rotates;
7 Controller 1210 controls the rotation of motor 1240 and the movement of arm 1214 to wind (e.g., lay) adjacent widths of filament 1220 around mandrel 1250 between front wall 816 and the rear-most position;
8. Controller 1210 moves arm 1214 in both directions adding another layer of filament as arm 1214 moves between front wall 816 and the rear-most position;
9. Filament 1220 is layered on mandrel 1250 as discussed above to apply about thirteen layers of filament 1220;
10. Upon winding the last layer of filament, machine 1200 or a user cuts filament 1220 at a position between electrode 810 and arm 1214 thereby creating a second end portion of filament 1220 with respect to winding 1222;
11. The second end portion of filament 1220 is positioned in channel 840 of front wall 816 and is coupled to retainer 850;
12. Body 812 and rear wall 818 are pushed (e.g., moved) forward to cover winding 1222 and to mechanically couple to front wall 816 by crimping (e.g., compressing, pinching) body 812 into groove 912; and
13. Remove (e.g., extract, pull) mandrel 1250 from recess 914 and winding 1222 through opening 970 of rear wall 818.

In an implementation, filament 1220 is an insulated wire having an outer diameter of about 5/1000 inches. In an implementation, the conductor of filament 1220 is a copper-clad steel that is insulated with a Teflon insulator. In an implementation, the insulator on filament 1220 includes a clear coat proximate to the conductor that is covered with a coat having a green color to provide greater visibility to the filament when used in the field.

Propulsion system 480 includes housing 482, pyrotechnic 490, conductor 492, canister 486, and anvil 484. Canister 486 is positioned and anvil 484 is partially positioned inside housing 482. Canister 486 includes cavity 498, which holds a pressurized gas sealed within canister 486 by lid 488. Anvil 484 includes channel 464 and outlet 494. Propulsion system 480 performs the function of a propulsion system discussed above.

Manifold 470 includes inlet 476, channel 478, wall 420, wall 422, and outlets 472 and 474. Manifold 470 performs the function of a manifold discussed above.

Deployment unit 210 cooperates with handle 230 to launch electrodes 410 and 440, propelled by the force of a rapidly expanding gas released by propulsion system 480. Propulsion system 480 is activated when launch generator 134 of handle 230 provides a launch signal via conductor 492 to ignite pyrotechnic 490.

A rapidly expanding gas produced by the burning (e.g., ignition) of pyrotechnic 490 applies a force to canister 486. The force moves canister 486 toward anvil 484. The force presses canister 486 against anvil 484 so that a portion of anvil 484 pierces (e.g., ruptures, opens) canister 486. Piercing canister 486 releases a compressed gas held within cavity 498. The compressed gas exits canister 486 into channel 464 of anvil 484. Channel 464 guides (e.g., directs) the rapidly expanding compressed gas from canister 486 to outlet 494 of anvil 484. Manifold 470 transports (e.g., delivers, directs) a rapidly expanding gas from a pierced canister 486 through inlet 476, channel 478, and outlets 472 and 474 to launch electrodes 410 and 440 positioned in bores 402 and 404, respectively.

The force provided by the rapidly expanding gas from canister 486 determines the speed at which electrodes 410 and 440 are launched toward a target. Preferably, the force provided by the rapidly expanding gas from canister 486 is consistent between deployment units so that the speed of launch of electrodes from different deployment units will be consistent. A consistent speed of launch of electrodes 410 and 440 contribute to consistent accuracy in flight and aiming of electrodes 410 and 440 with respect to a target. Variations in the force provided by the compressed gas stored in cavity 498 of canister 486 reduces the accuracy of launch of electrodes 410 and 440.

Two sources of variation in the force provided by the compressed gas in canister 486 include variations in the filling of cavity 498 of canister 486 and loss of gas from manifold 470.

A first implementation of manifold 470, manifold 470 was divided into several sections which are formed using injection molding. The parts were rigid to provide strength and were welded together to form manifold 470. The small parts provide shapes that are easily molded using injection molding; however, difficulties in assembly and joining the parts resulted in gaps between the parts and thereby gas leaks from manifold 470. The gas leaks reduced the force of the expanding gas delivered to launch electrodes 410 and 440, the accuracy of electrodes in flight, and force of impact of the electrodes with the target.

The leaking of gas from a manifold formed from smaller parts may be overcome by forming manifold 470 as a single piece of material. However, forming manifold 470 in a single piece precludes the use of injection molding because the one-piece manifold could not be removed from the mold.

Forming manifold 470 from a flexible (e.g., pliable) material (e.g., silicone, rubber) permits molding manifold 470 as a single piece which can be removed from a mold. However, a concern regarding a manifold formed of a flexible material was that the flexile material could not withstand the force applied by the expanding gas and would therefore structurally fail (e.g., blow out, compress, rupture, deform, separate). Prototypes of manifold 470 formed from silicone have shown that adding support walls 420 and 422 in housing 300 to provide support to a flexible manifold 470 enable flexible manifold 470 to deliver the rapidly expanding gas from canister 486 to bores 402 and 404 without structural failure and without suffering losses (e.g., leaks) of the gas from flexible manifold 470. Further, a flexible material enables manifold 470 to better seal to outlet 494 of anvil 484 and to the inlets of bores 402 and 404 thereby further reducing gas leaks. Accordingly, a manifold formed of flexible materials is manufacturable using conventional injection molding techniques while still delivering the rapidly expanding gas with little or no loss.

Canister 486 includes body 496, cavity 498, lid 488, and notches 1612. Canister 486 performs the function of a canister discussed above.

Canister 486 holds (e.g., retains) a compressed gas (e.g., air, nitrogen, inert). Rapid release of the gas from canister 486 provides a force for propelling electrodes 410 and 440 from deployment unit 210. Canister 486 is filled with compressed gas by positioning canister 486 in a pressurized environment that contains a gas at a high pressure. While canister 486 is in the pressurized environment, cavity 498 is filled with the gas at the high pressure. Canister 486 is then sealed while still positioned in the high-pressure environment so that canister 486 retains the compressed gas in cavity 498.

A portion of lid 488 is welded to body 496 prior to inserting canister 486 into the high-pressure environment to reduce the difficulty and cost of welding lid 488 to body 496 to seal the high-pressure gas in cavity 498. Partial welding of lid 488 to body 496 closes some of the notches 1612, but leaves multiple notches open thereby allowing the compressed gas to flow freely into cavity 498. When cavity 498 is at the same pressure as the environment, the remainder of lid 488 is welded to body 496 thereby trapping the high-pressure gas in cavity 498 of canister 486.

The size of notches 1612 provide passages 1812 for the high-pressure gas to enter and completely fill cavity 498, so that the pressure and volume of gas held in cavity 498 is consistent across multiple canisters in different manufacturing lots. The consistent filling of canisters with gas at the same pressure provides high-pressure canisters with little variation in pressure over many lots. Manufacturing canisters that are filled to a consistent high-pressure and volume of gas increases the distance, predictability and accuracy of launching electrodes from a deployment unit.

Further embodiments are described below.

A method for forming a winding of a filament for an electrode for a conducted electrical weapon, the method comprising: pushing an end portion of a mandrel through an opening in a rear wall of the electrode toward a front wall of the electrode until the end portion of the mandrel enters a recess in the front wall, whereby the mandrel remains positioned in the opening; pushing a first end portion of the filament through the opening alongside the mandrel thereby positioning the first end portion of the filament rearward of the rear wall, the first end portion of the filament remains positioned through the opening and rearward of the rear wall before, during, and after forming the winding; rotating the mandrel to wind the filament around the mandrel to form a winding; and after forming the winding: positioning a second end portion of the filament forward of the front wall; and coupling a body of the electrode to the front wall whereby the body encloses the winding; and removing the mandrel so that the winding remains in the body positioned between the front wall and the rear wall.

The above method wherein rotating further comprises moving an arm with respect to the mandrel to form successive layers of the filament around the mandrel to form the winding.

The above method wherein: pushing the end portion of the mandrel comprises pushing the mandrel in a first direction; and pushing the first end portion of the filament comprises pushing the first end portion of the filament in a second direction opposite the first direction.

The above method wherein coupling comprises coupling the body to a band positioned in a groove of the front wall whereby the second end portion of the filament is trapped between the body and the front wall to retain the second end portion of the filament.

The above method wherein positioning the second end portion comprises: positioning the second end portion in a channel of the front wall; and crimping one or more walls of the channel to retain the filament in the channel.

The above method wherein positioning the second end portion comprises: positioning the second end portion in a retainer of a channel of the front wall; and crimping the retainer to retain the filament in the channel.

The above method wherein coupling the body to the front wall comprises crimping a portion of the body into a groove of the front wall.

The above method wherein coupling comprises: moving the body toward the front wall to bring a portion of the body in contact with the front wall thereby enclosing the winding; and crimping the portion of the body into a groove of the front wall.

An electrode for a conducted electrical weapon ("CEW"), the electrode configured to cooperate with a provided winding machine to form a winding, the electrode comprising: a front wall, the front wall includes a recess; a rear wall, the rear wall includes an opening; a spear coupled to the front wall; a body having a cavity therein, the cavity for enclosing the winding, a forward portion of the body is configured to couple to the front wall, a rearward portion of the body coupled to the rear wall; wherein: before the forward portion of the body is coupled to the front wall: a mandrel of the winding machine is inserted into the opening of the rear wall until an end portion of the mandrel rests in the recess of the front wall; the mandrel rotates as a filament is provided to form the winding; and the mandrel is removed from the recess and the opening in the rear wall whereby the winding remains inside the cavity of the body.

The above electrode wherein a shape of the opening in the rear wall comprises a triangle whereby the mandrel and an end portion of the filament fit through the opening at the same time.

The above electrode wherein an arm of the winding machine moves with respect to the mandrel as the mandrel rotates to wind successive layers of the filament around the mandrel to form the winding.

The above electrode wherein the front wall further comprises a band wherein: the forward portion of the body couples to the band to couple the body to the front wall; a first end portion of the filament is trapped between the body and the front wall to retain the first end portion of the filament.

The above electrode wherein the front wall further comprises a channel wherein: a first end portion of the filament is positioned in the channel; the first end portion of the filament extends forward of the front wall; at least one wall of the channel is deformed to retain the first end portion of the filament in the channel The above electrode wherein the front wall further comprises a channel and a retainer wherein: a first end portion of the filament is positioned in the channel and in the retainer; the retainer is deformed to retain the first end portion of the filament coupled to the front wall.

An electrode for a conducted electrical weapon ("CEW"), the electrode comprising: a front wall; a spear, the spear coupled to the front wall, the spear for coupling the electrode to a human or animal target to deliver a current to the target to impede locomotion of the target; a metal band, the metal band positioned at least partially around the front wall, the metal band coupled to the front wall; a winding of a filament, the filament for providing the current to at least one of the spear and the target; a rear wall, the rear wall includes an opening; a body having a cavity therein, the winding positioned in the cavity, a forward portion of the body coupled to the band, a rearward portion of the body coupled to the rear wall; wherein: a first end portion the filament extends rearward of the rear wall through the opening, the first end portion for coupling to a provided signal generator of the CEW, the signal generator for providing the current; a second end portion of the filament extends forward of the front wall to provide the current via a circuit formed by at least one of contact and ionization; and the second end portion of the filament is coupled to the electrode and remains coupled before, during, and after impact of the electrode with the target.

The above electrode wherein the second end portion of the filament is positioned in a channel in the front wall.

The above electrode wherein the body applies a force on the second end portion of the winding in the channel to couple the second end portion of the filament to the electrode.

The above electrode wherein the body is coupled to the band by welding.

A deployment unit for launching a wire-tethered electrode toward a human or animal target to deliver a current through the target to impede locomotion of the target, the deployment unit comprises: an anvil having an inlet and an outlet; a canister, the canister contains a pressurized gas; a bore having an inlet and an outlet; a manifold having an inlet, an outlet and a passage between, the manifold formed of a flexible material, the manifold constructed as a single piece; the wire-tethered electrode, the wire-tethered electrode positioned in the bore; a first wall and a second wall, the first wall positioned proximate to an exterior of the manifold on a first side of the manifold, the second wall positioned proximate to an exterior of the manifold on a second side of the manifold; the anvil pierces the canister to release the pressurized gas; the pressurized gas enters the inlet of the anvil; the pressurized gas exits the outlet of the anvil into the inlet of the manifold; a force of the expanding gas in the passage presses the exterior of the manifold on the first side and second side against the first wall and second wall respectively; the pressure on the first side and on the second side applies a force on the manifold to seal the flexible material of the inlet of the manifold to the outlet of the anvil and flexible material of the outlet of the manifold to the inlet of the bore to reduce leakage of the pressurized gas around the from the inlet and the outlet of the manifold; the single piece construction of the manifold transfers the rapidly expanding gas from the canister to the bore via the passage with little or no leakage of the pressurized gas from the manifold; the rapidly expanding gas exits the outlet of the manifold into the inlet of the bore; the force of the rapidly expanding gas pushes the electrode out the outlet of the bore to launch the electrode toward the target.

The above deployment unit wherein the first side of the manifold is opposite the second side of the manifold.

The above manifold wherein the manifold is manufacturable using conventional injection molding techniques.

A canister for providing a rapidly expanding gas to launch a wire-tethered electrode toward a human or animal target to provide a current through the target to impede locomotion of the target, the canister comprising: a body, the body having a cavity for holding a pressurized gas; an opening, the opening providing fluid communication between the cavity and an atmosphere surrounding the body; a lid having a plurality of notches around a circumference of the lid, the lid for sealing the opening to retain the pressurized gas in the cavity, wherein: prior to placing the canister into an atmosphere of the pressurized gas: the lid is positioned over the opening and welded to the body around a first portion of the circumference of the lid; welding the lid along the first portion of the circumference seals the notches around the first portion of the circumference whereas the notches around the second portion of the lid remain open thereby providing fluid communication with the cavity; after placing the canister into the atmosphere of the pressurized gas: the pressurized gas enters the cavity via the notches around the second portion of the circumference; and welding the lid along the second portion of the circumference seals the notches of the second portion thereby sealing the pressurized gas in the cavity.

The foregoing description discusses embodiments, which may be changed or modified without departing from the scope of the invention as defined in the claims. Examples listed in parentheses may be used in the alternative or in any practical combination. As used in the specification and claims, the words 'comprising', 'comprises', 'including', 'includes', 'having', and 'has' introduce an open-ended statement of component structures and/or functions. In the specification and claims, the words 'a' and 'an' are used as indefinite articles meaning 'one or more'. While for the sake of clarity of description, several specific embodiments of the invention have been described, the scope of the invention is intended to be measured by the claims as set forth below. In the claims, the term "provided" is used to definitively identify an object that not a claimed element of the invention but an object that performs the function of a workpiece that cooperates with the claimed invention. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing". The invention includes any practical combination of the structures and methods disclosed. While for the sake of clarity of description several specifics embodiments of the invention have been described, the scope of the invention is intended to be measured by the claims as set forth below.

The location indicators "herein", "hereunder", "above", "below", or other word that refer to a location, whether specific or general, in the specification shall be construed to refer to any location in the specification whether the location is before or after the location indicator.

What is claimed is:

1. An electrode for a conducted electrical weapon ("CEW"), the electrode comprising:
- a cylindrical body;
- a front wall coupled to a forward end of the cylindrical body; and
- a filament having an end portion coupled to the front wall at a location between a radially outer edge of the front wall and the forward end of the cylindrical body.

2. The electrode of claim 1, wherein the end portion of the filament is mechanically coupled to the front wall.

3. The electrode of claim 1, wherein the front wall is formed of a metal configured to conduct a stimulus signal provided by the filament.

4. The electrode of claim 1, wherein the end portion of the filament extends forward the location between the radially outer edge of the front wall and the forward end of the cylindrical body.

5. The electrode of claim 1, wherein the front wall comprises a channel, and wherein the end portion of the filament is positioned within the channel.

6. The electrode of claim 5, wherein the end portion of the filament passes through the channel and extends forward the location between the radially outer edge of the front wall and the forward end of the cylindrical body.

7. The electrode of claim 5, wherein the end portion of the filament is retained within the channel.

8. The electrode of claim 1, wherein the cylindrical body is deformed to couple the forward end of the cylindrical body to the front wall.

9. The electrode of claim 8, wherein the front wall comprises a groove, and wherein the cylindrical body is deformed into the groove.

10. The electrode of claim 9, wherein the end portion of the filament is positioned through the groove.

11. The electrode of claim 9, wherein the front wall comprises a channel, wherein the channel extends forward the groove, and wherein the end portion of the filament is positioned within the groove and the channel.

12. A deployment unit for a conducted electrical weapon ("CEW"), the deployment unit comprising:
- a propulsion system; and
- an electrode configured to be launched by the propulsion system, wherein the electrode comprises:
  - a body;
  - a front wall;
  - a spear coupled to the front wall at a first location, wherein the first location is proximate a radial centerpoint of the front wall; and
  - a filament having an end portion coupled to the front wall at a second location, wherein the second location is between a circumferential edge of the front wall and an inner surface of the body, and wherein the second location is radially outward from the first location.

13. The deployment unit of claim 12, wherein the body is coupled to the front wall proximate the second location.

14. The deployment unit of claim 12, wherein the filament is configured to be stored in a cavity of the body.

15. The deployment unit of claim 14, wherein the filament is wound into a winding within the cavity of the body.

16. An electrode for a conducted electrical weapon ("CEW"), the electrode comprising:
- a cylindrical body;
- a front wall coupled to the cylindrical body; and
- a filament having an end portion coupled to the front wall proximate a circumferential edge of the front wall, wherein the end portion of the filament is positioned radially inward from the cylindrical body.

17. The electrode of claim 16, wherein the end portion of the filament is coupled to the front wall between the circumferential edge of the front wall and the cylindrical body.

18. The electrode of claim 16, wherein the cylindrical body is positioned around the front wall.

19. The electrode of claim 16, wherein the front wall is formed of a first metal, wherein the cylindrical body is formed of a second metal, and wherein the first metal is different from the second metal.

20. The electrode of claim 16, wherein the filament is electrically coupled to the front wall.

* * * * *